United States Patent [19]

Schindler et al.

[11] Patent Number: 4,707,948

[45] Date of Patent: Nov. 24, 1987

[54] FLOAT LAPPING FIXTURE

[75] Inventors: Abbott M. Schindler, Chatsworth; Otto Fuchs, Westlake Village, both of Calif.

[73] Assignee: Unisys Corp., Detroit, Mich.

[21] Appl. No.: 299,086

[22] Filed: Nov. 27, 1981

[51] Int. Cl.[4] ..... B24B 37/04

[52] U.S. Cl. ..... 51/216 R; 51/131.4

[58] Field of Search ..... 51/216 R, 236 R, 237 R, 51/129, 131.1, 131.2, 131.3, 131.4, 283 R, 281 R

[56] References Cited

U.S. PATENT DOCUMENTS

| | | | |
|---|---|---|---|
| 426,671 | 4/1890 | Macbeth | 51/131.2 |
| 1,467,992 | 9/1923 | Becker | 51/131.4 |
| 2,634,558 | 4/1953 | Wolfskill | 51/131.2 |
| 2,722,089 | 11/1955 | Boettcher | 51/131.2 |
| 2,979,868 | 4/1961 | Emeis | 51/131.2 |
| 2,983,086 | 5/1961 | Chapelle | 51/237 R |
| 3,867,797 | 2/1975 | Meier | 51/131.2 |

FOREIGN PATENT DOCUMENTS

| | | | |
|---|---|---|---|
| 1349280 | 12/1963 | France | 51/237 R |

*Primary Examiner*—Harold D. Whitehead

*Attorney, Agent, or Firm*—John J. McCormack; Nathan Cass; Kevin R. Peterson

[57] ABSTRACT

Described is a technique and associated fixture for lapping magnetic recording heads in a group such that each head is mounted on a "free floating" part in the fixture, being biased for lapping only by the weight of this part and being individually removable during lapping mode; and also characterized by capability for pivoting the fixture to change the lap-angle of all such heads in common to a new constant prescribed angle, the parts also being selectibly kept non-rotatable in the fixture.

3 Claims, 4 Drawing Figures

FLOAT LAPPING FIXTURE

BACKGROUND, INVENTION FEATURES

This invention relates to magnetic recording heads and more particularly to methods for lapping the faces thereof.

In the art of making magnetic recording heads (sliders) such as tunnel-erase heads for recording on floppy disks, workers know that it is necessary to lap and polish one or more surfaces thereof to a very high degree—and usually in two directions (e.g., flat and tapered surfaces). This is often a problematical step especially since, while a number of head units can be lapped and polished simultaneously and relatively automatically, they all typically must be lapped in identical fashion (i.e., present equipment doesn't tolerate easy insertion and/or removal of individual heads from a common fixture or individual bias thereof, etc.). This invention is directed toward resolving this shortcoming.

A typical known lapping table L-T is here assumed. Workers will recognize that table L-T typically comprises a rotating surface on which the lapping compound (e.g., silicon carbide in liquid vehicle) is applied so that when it is rotated at prescribed rpm then one or several lapping rings R and lapping fixtures F therewithin may be placed thereon, and being held in place (see mount RM) be allowed to rotate about their axis on table L-T as they are spun.

Thus, workers will recognize how conventional lapping fixtures, though advantageous in many ways, suffer from the drawback of not allowing each head to be separately and individually biased for lapping and to be individually inserted or removed during lapping (e.g., for inspection or for various different lapping schedules) while the fixture is kept rotating on the lapping table. The present invention provides a solution to this problem in a novel "floating lapping fixture" and associated technique.

BRIEF DESCRIPTION OF THE DRAWINGS

The foregoing and other features and advantages of the present invention will be appreciated by workers as they become better understood through reference to the following detailed description of preferred embodiments which should be considered in conjunction with the accompanying drawings, wherein like reference symbols denote like elements.

DESCRIPTION OF PREFERRED EMBODIMENTS

The following description of methods and associated fixtures is given by way of esample to indicate preferred embodiments according to the invention. Except as otherwise specified, workers should assume that conventional related methods, conditions, materials, etc., obtain throughout, conforming to present good practice in the art.

Figure 1:
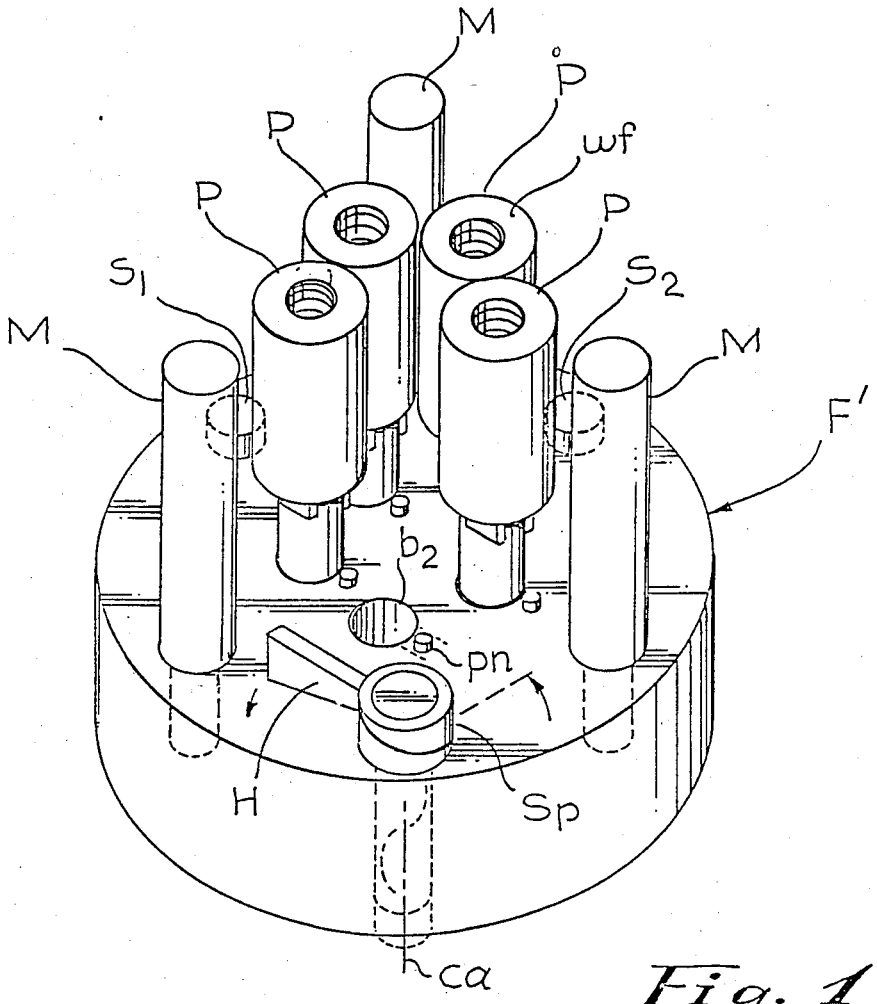
FIG. 1 is a drawing from a xero-photo taken in upper perspective of a preferred lapping fixture embodiment, showing it from the top and from the bottom, as well as depicting a sample plunger removed therefrom.

FIG. 1 is a xero-photo of the preferred "floating lap fixture" embodiment seen from its topside F' and also in perspective from the bottom lap-plane confronting side F, along with one of the five insertable plungers P (on which an individual head is to be mounted as workers well know).

The fixture includes three conventional resting posts M on which it may stand in "non-operating" condition as at F in FIG. 1, along with three stops $S_1$, $S_2$ and $S_p$. These stops include diamond tips adapted to establish the "lapping plane" on a lapping table as is conventional. However, one of the stops $S_p$ is made pivotable between two prescribed positions as detailed below according to a feature of this invention.

Figure 2:
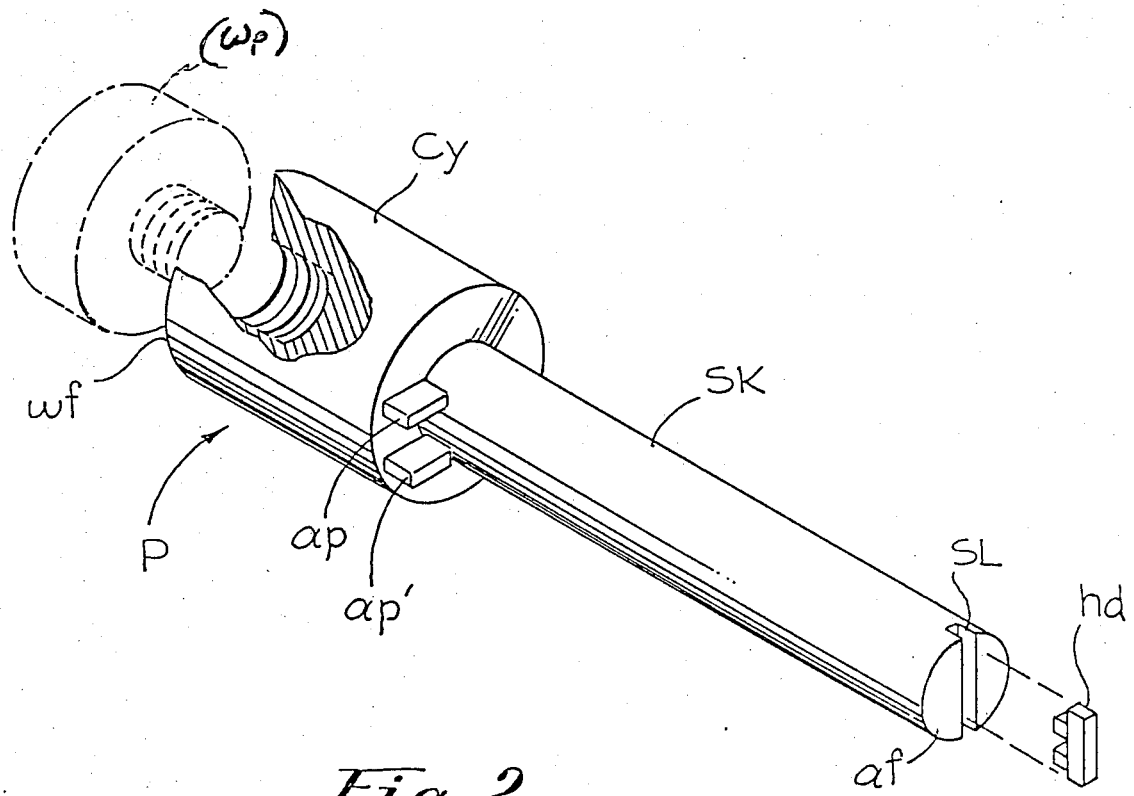
FIG. 2 is an upper perspective of such a head-mounting plunger modified according to the invention.

Also a set of five (or any convenient number) bores $b_1$ through $b_5$ are provided, each being adapted to slidingly receive a stock SK of a plunger such as plunger P shown in FIG. 2. The plunger is adapted to be received therein in smooth sliding relationship being allowed to freely "float" toward and away from the lapping plane. It is unrestrained in these bores which only serve to align it (normal to the lapping plane, as is conventional).

Attached to each stock SK is a cylindrical weight section Cy adapted to provide a prescribed gravitational weight-bias on the lapping attachment face af of stock SK when a head such as head hd is attached thereto as known in the art. Face af includes a slot SL for receiving the usual core legs on the bottom of a typical slider—the slider to be epoxy bonded or otherwise temporarily secured firmly to face af as known in the art.

For instance, as indicated in FIG. 1 an attachment threaded-hole may be tapped on surface wf of cylinder Cy so that weights with threaded screw attachments may be coupled there to supplement the weight of cylinder Cy (according to how much more gravitational-bias force is to be applied to head hd attached on stock SK, e.g., to grind it faster or deeper than its neighbors mounted on the same fixture F).

Workers will recognize the major advantage of such "floating" lap fixtures wherein individual head mounting plungers are free floating and individually weighted, being adapted for individual insertion and removal even during lapping, (i.e., while the fixture is mounted to rotate on a lapping table). They will recognize that this is something quite new in the art and quite useful, providing the mentioned features and advantages.

For instance, workers will recognize that where five heads are mounted on five plungers P as shown, one or several of the heads may require a different lapping schedule and thus, after the fixture has been placed on the lapping table, various plungers P may be inserted and removed to adjust their own lapping schedule (time, degree) individually—apart from the overall schedule for the fixture F which can be left rotating on the table. Also, workers may, from time to time, remove a plunger and inspect its head to monitor individual lapping progress without removing or interrupting the lapping rotation of fixture F.

Also, this free floating of the plungers allows the stops to be fixed and non-adjustable in height, generally speaking; as opposed to the prior art where height must be adjusted. This is because the heads on the individually floating plungers find their own lapping height by simply "falling to ground" on the lapping table. They may even bounce up and down on the table without significantly disturbing the desired lapping action since their orientation to the table is kept constant by the bore b in which they are slidably mounted.

Figure 3:
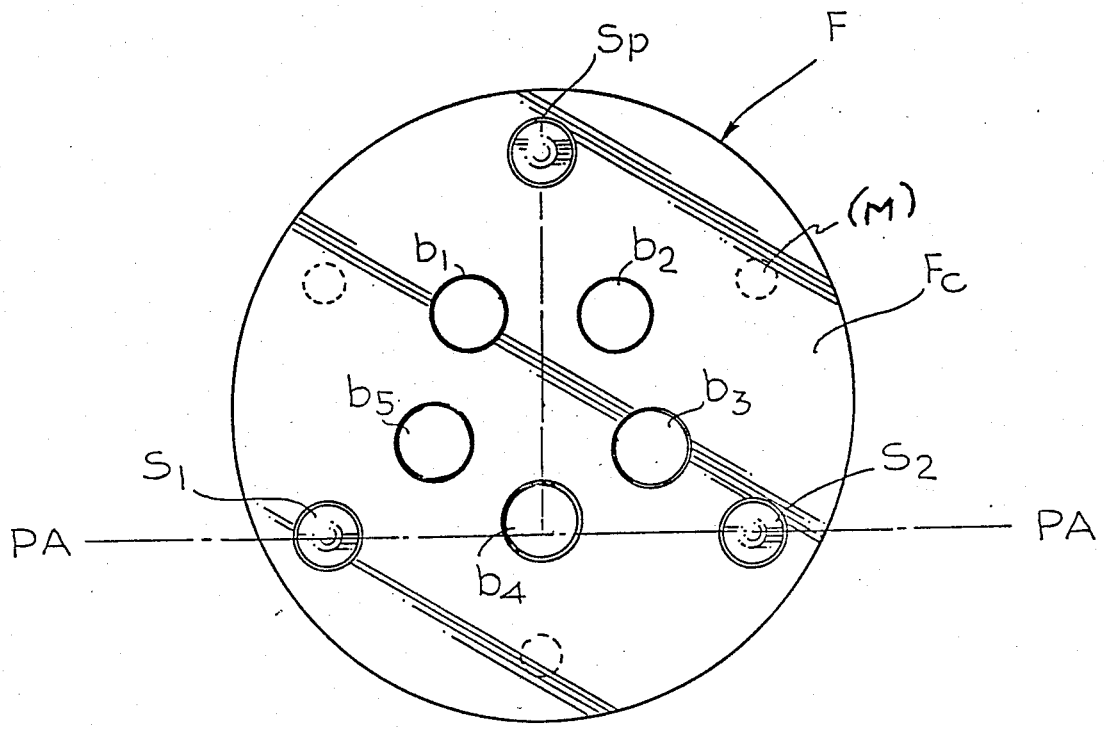
FIG. 3 is a relatively schematic plan view of the bottom side of this embodiment (intended for contact with a lapping surface)
Figure 4:
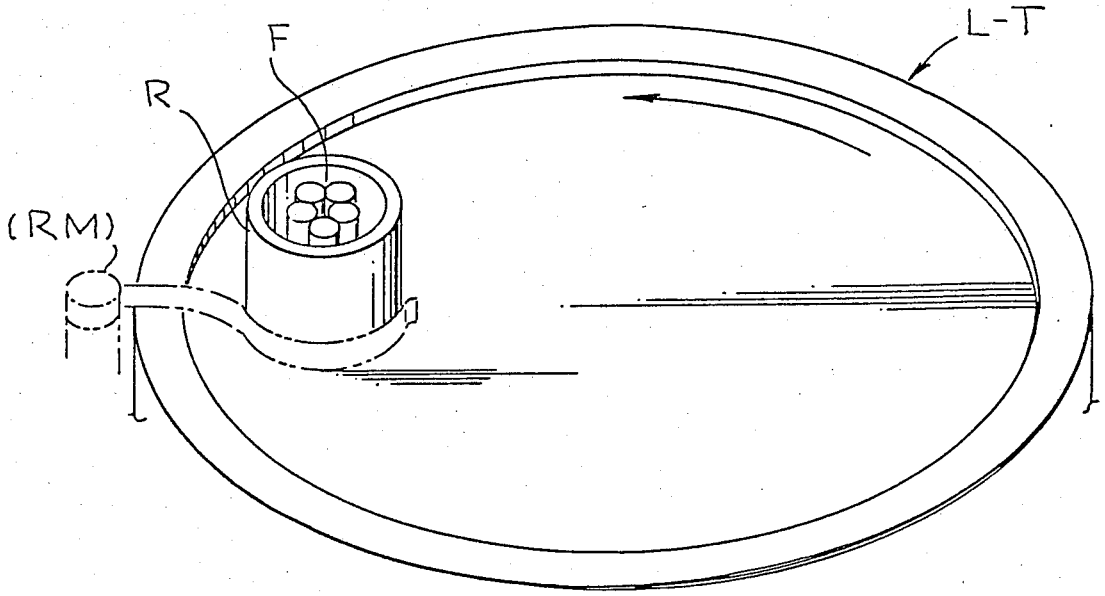
FIG. 4 is a drawing from a xero-photo of the top face of this embodiment.

According to another improvement feature, best seen in FIG. 3, one of the stops $S_p$ is made height-adjustable. Thus, for instance, stop $S_p$ is like the other two ("fixed") stops $S_1$, $S_2$ except that it is made pivotable between two height positions, being mounted in the body of fixture F to be contacted by a rotatable cam axle ca. Axle ca will be seen as rotatable (e.g., by handle H) between a first position, and a second position whereby to provide the tilt-adjustment desired.

The fixed stops $S_1$, $S_2$ will be understood as aligned along a prescribed pivot axis PA—PA as indicated in FIG. 3, with pivotable stop $S_p$ mounted along an orthogonal axis, preferably bisecting PA—PA. Thus, as stop $S_p$ is extended and thrust outward to pivot fixture F away from the lapping table (e.g., with handle H), the lapping face $F_c$ of the fixture will be tilted about axis PA—PA in a prescribed manner. Thus, stop $S_p$ may be kept in a first position for lapping all the heads (on the ends af of plungers P) relatively "flat", while rotation of handle H may thrust stop $S_p$ outward to rotate the table about axis PA—PA so that a prescribed common bevel angle (taper) may be cut into each of these heads. Workers will recognize that this is a surprisingly and conveniently simple, yet effective, way of accommodating two different lapping angles on a single novel "floating fixture".

Preferably and according to an improvement feature, the plungers P may be provided with anti-rotation means, such as a pair of parallel brackets ap, ap' (seen in FIG. 2) which when registered about an associated pin (such as pn in FIG. 3) may restrain the plunger from rotating during (certain lapping operations. Rotation relative to fixture F may be allowed in many cases, however, in certain cases (such as the mentioned taper-lap sequence as described above when stop $S_p$ is extended), it will be necessary to restrain their rotation to ensure that the same common taper angle is cut in common orientation relative to each head hd. Thus, the pins pn are preferably provided adjacent each bore b and are oriented along a common direction relative to pivot axis PA—PA as shown in FIG. 3.

It will be understood that the preferred embodiment described herein are only exemplary, and that the invention is capable of many modifications and variations in construction, arrangement and use without departing from the spirit of the invention.

Further modifications of the invention are also possible. For example, the means and methods disclosed herein are also applicable for other like head machining techniques, especially where a plurality of heads are to be co-machined in a common fixture—even more especially where a number of different common angles are to be cut. Also, the present invention is applicable for like operations on other workpieces requiring similar treatment.

The above examples of possible variations of the present invention are merely illustrative. Accordingly, the present invention is to be considered as including all possible modifications and variations coming within the scope of the invention as defined by the appended claims.

What is claimed is:

1. A "floating lap" fixture wherein a plurality of work-mounting parts are individually and separately slide-mounted in a fixture body so as to each "float" on the lapping surface, biased theretoward only by its own weight; these parts comprising plungers for mounting magnetic recording sliders; with the fixture being supported on the lapping surface by three stop means, one of which is made height-adjustable.

2. The fixture of claim 1 wherein said plungers are also provided with anti-rotation means adapted, when invoked, to prevent rotation of the floating plunger relative to said fixture.

3. The fixture of claim 2 wherein said anti-rotation means comprises bracket means mounted to project from the plungers plus stop means mounted on the adjacent fixture body and adapted to be engaged by said bracket means.

* * * * *